US005310153A

United States Patent [19]

Jackson

[11] Patent Number: 5,310,153

[45] Date of Patent: May 10, 1994

[54] QUICK RELEASE WASHER FOR A SHORING POST

[76] Inventor: George W. Jackson, 2570 Drew Road, Mississauga, Ontario, Canada, L4T 3M5

[21] Appl. No.: 28,876

[22] Filed: Apr. 26, 1993

[51] Int. Cl.[5] ..... A47F 5/00

[52] U.S. Cl. ..... 248/354.5; 248/161

[58] Field of Search ..... 248/354.5, 352, 354.3, 248/354.1, 161; 254/11

[56] References Cited

U.S. PATENT DOCUMENTS

| | | | |
|---|---|---|---|
| 1,022,036 | 4/1912 | McLendon | 248/354.5 X |
| 2,439,854 | 4/1948 | Lipski | 248/354.5 X |
| 2,468,484 | 4/1949 | Clark | 248/354.5 X |
| 2,777,660 | 1/1957 | Albrecht | 248/354.5 |
| 3,847,340 | 11/1974 | Ficken . | |
| 3,870,268 | 3/1975 | Larkin . | |
| 4,036,466 | 7/1977 | Van Meter . | |
| 4,470,574 | 9/1984 | Jackson . | |
| 4,690,361 | 9/1987 | Lundman | 248/352 |
| 4,752,057 | 6/1988 | Hagemes | 248/354.3 X |
| 4,811,924 | 3/1989 | Walters | 254/11 X |
| 5,112,155 | 5/1992 | Jackson . | |

FOREIGN PATENT DOCUMENTS

| | | | |
|---|---|---|---|
| 1025355 | 4/1953 | France | 248/354.5 |
| 620177 | 3/1949 | United Kingdom | 248/354.5 |

*Primary Examiner*—J. Franklin Foss

*Attorney, Agent, or Firm*—Jeffrey T. Imai; Arne I. Fors; D. Doak Horne

[57] ABSTRACT

A shoring post comprises a support post slidingly engaging a telescoping sleeve member and a screw device for incrementally adjusting the length of the shoring post. The telescoping member having a plurality of pairs of diametrically opposed holes spaced therealong. A pin member for inserting through a pair of the diametrically opposed holes of the telescoping member to releasably extend the shoring post. A quick release washer for quickly reducing an overall length of the shoring post. The washer comprising a ring portion having a pair of diametrically opposed cam lobes. The lobes having an inclined surface, a cradling surface and a stop. The washer is mounted between the pin and the support post. The washer has a load transfer position wherein the pin is cradled between the cradling surface and the stop surface and a quick release position whereby as the washer is rotated relative to the pin, the pin travels along the inclined surface reducing the overall length of the shoring post.

7 Claims, 3 Drawing Sheets

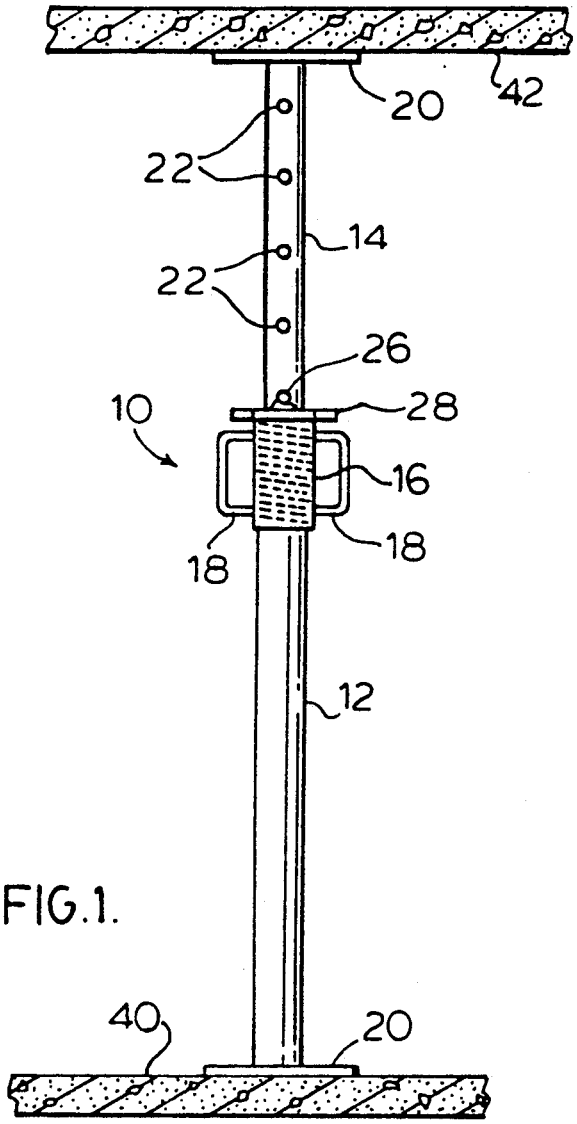
FIG.1.
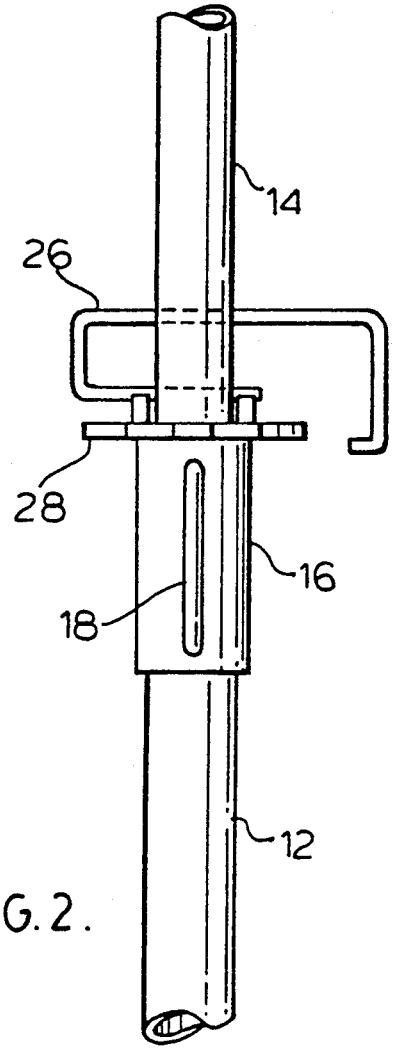
FIG. 2.
FIG.3.
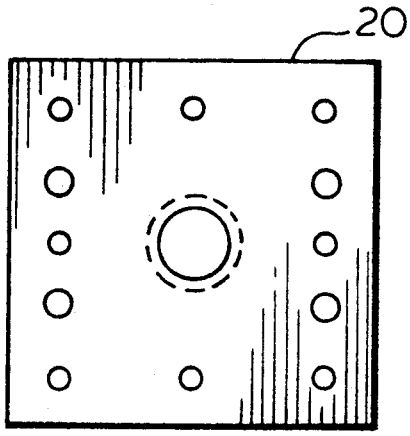

QUICK RELEASE WASHER FOR A SHORING POST

FIELD OF INVENTION

This invention relates to a device for quickly releasing pressure being exerted on a shoring post and/or similar support equipment where it is desirable to easily loosen a nut of the shoring post while it is supporting a compressive load.

BACKGROUND OF THE INVENTION

In the construction industry, shoring is widely used to support forms for concrete construction of buildings, bridges and other structures. Flying forms such as those described in a copending U.S. application Ser. No. 07/653,549, filed Feb. 11, 1991, can be used to construct buildings using a flying form method. Other types of support structures are described in an earlier U.S. Pat. No. 4,470,574. Once the concrete has initially cured, the support structure is removed and advanced to other locations. However, the concrete has not yet fully cured and able to support its own weight load and the additional loads of additional shoring and other equipment and the new concrete being poured as upper floors. Accordingly shoring posts are used to support the curing concrete structure until it has sufficiently cured.

Shoring posts are well known in the art. Shoring posts of the prior art include U.S. Pat. Nos. 3,870,268 and 3,847,340. Generally shoring posts comprise a telescoping sleeve slidably mounted in a support post. The sleeve has a plurality of aligned diametrically extending holes through which a pin can be inserted. The length of the shoring post can be roughly fixed by inserting the pin through the hole nearest the desired height. A screw thread is mounted on the post or machined into the outer surface of the post and a threaded nut or handle is advanced to extend the post until it fully supports the load.

Shoring posts of the prior art perform reasonably adequately. However at times, unloading the shoring posts can be difficult. Since the shoring post is under a compressive load, especially if the shoring post is used to support forms in which concrete is poured, the adjusting nuts on the shoring post are often difficult to unscrew. Hammers are often used to unscrew the nut of the screw jack. Since the screw thread is normally adapted for incremental extensions of the shoring post between adjusting holes, unscrewing the post nut in this manner is time consuming.

In U.S. Pat. No. 3,870,268, a release slide is described. The release slide has a thicker portion and a thinner portion which extends diametrically through holes between the lower tube and the telescoping tube. The slide is urged across from the thicker portion to the thinner portion reducing the length of the shoring post releasing the pressure acting thereon. The holes through which the release slide acts is often damaged during normal usage. The release slide normally has a circular cross-section. This geometry results in the pressure loads to be transmitted from the telescoping tube to the outside lower tube through two diametrically opposed points. The holes in the telescoping tube and the lower tube often become deformed out of shape dramatically reducing the life of the shoring post.

SUMMARY OF THE INVENTION

The disadvantages of the prior art may be overcome by providing a device for quickly releasing the loading of a shoring post yet is capable of transmitting and supporting the pressure load acting on the shoring post without damage.

According to one aspect of the invention, there is provided a shoring post comprising a support post slidingly engaging a telescoping member and a screw device for incrementally adjusting the length of the shoring post. The telescoping member having a plurality of pairs of diametrically opposed holes spaced therealong. A pin member for inserting through a pair of the diametrically opposed holes of the telescoping member to adjust and releasably extend the shoring post. A quick release washer for quickly reducing an overall length of the shoring post. The washer comprises a ring portion having a pair of diametrically opposed cam lobes. The lobes having an inclined surface, a cradling surface and a stop. The washer is mounted between the pin member and the outer support portion of the shore post. The washer has a load transfer position wherein the pin is cradled between the cradling surface and the stop surface and a quick release position whereby as the washer is rotated relative to the pin, the pin travels along the inclined surface reducing the overall length of the shoring post.

DESCRIPTION OF THE DRAWINGS

In Figures which illustrate embodiments of the invention,

FIG. 1 is a front elevational view of the shoring post of the present invention;

FIG. 2 is a side elevational view of the pin, collar and washer of the invention of FIG. 1;

FIG. 3 is a bottom view of an end plate of the shoring post of the invention of FIG. 1;

DETAILED DESCRIPTION OF THE INVENTION

Figure 4:
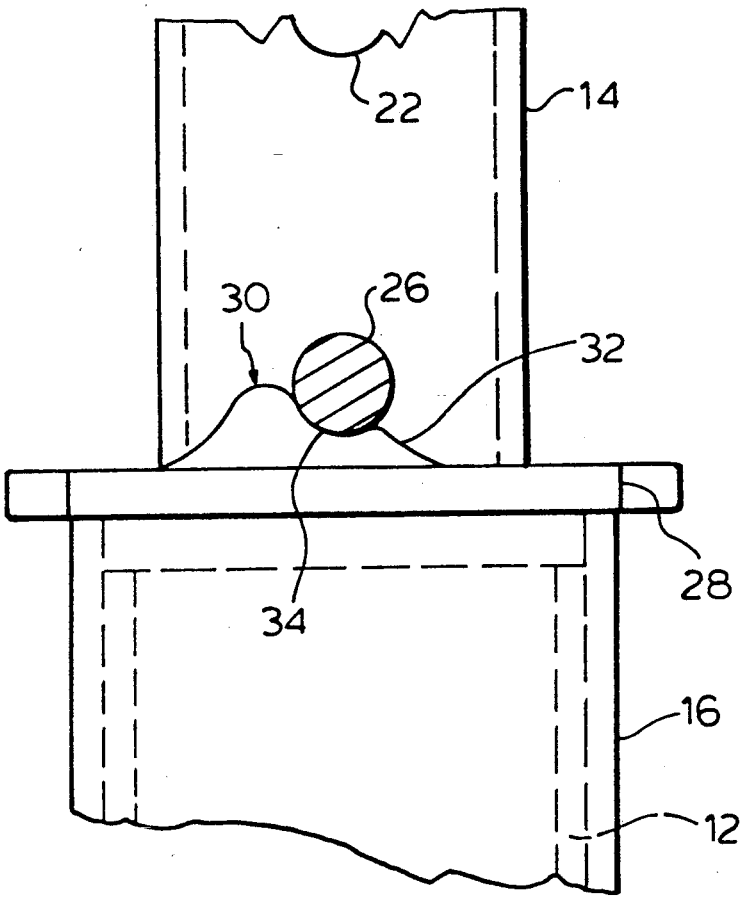
FIG. 4 is a side elevational view of the pin, collar and washer of the invention of FIG. 1.

The shoring post of the present invention is generally illustrated as 10 in FIG. 1. The shoring post comprises a support post 12 and a telescoping tube 14.

At the upper end of support post 12 is an adjustment handle 16. Handle 16 has a tubular body having an internal thread and a pair of U-shaped handles 18. Adjustment handle 16 threadably engages a screw thread on the outside surface at one end support post 12. Rotation of the handle 16 will advance the handle along the screw thread of support post 12. The lower end of support post 12 has plate 20 welded thereto.

Shoring post 10 is a cylindrical telescoping tube having a circular cross section in the preferred embodiment. Other cross sectional shapes of tubing may be used with satisfactory results.

Telescoping sleeve 14 has an outside diameter less than the inside diameter of support post 12 for telescoping within support post 12 in a sliding fit. Sleeve 14 has a plurality of diametrically opposed holes 22 spaced along the axial length of the sleeve. An end plate 20 is welded to the upper end of sleeve 14. Washer 28 rests between pin 26 and adjustment handle 16. Pin 26 extends through the pair of holes 22 in telescoping sleeve 14. Pin is preferable shaped as illustrated in FIG. 2 which is a type of pin which can be easily inserted through the holes but is prevented from accidentally falling out.

Figure 5:
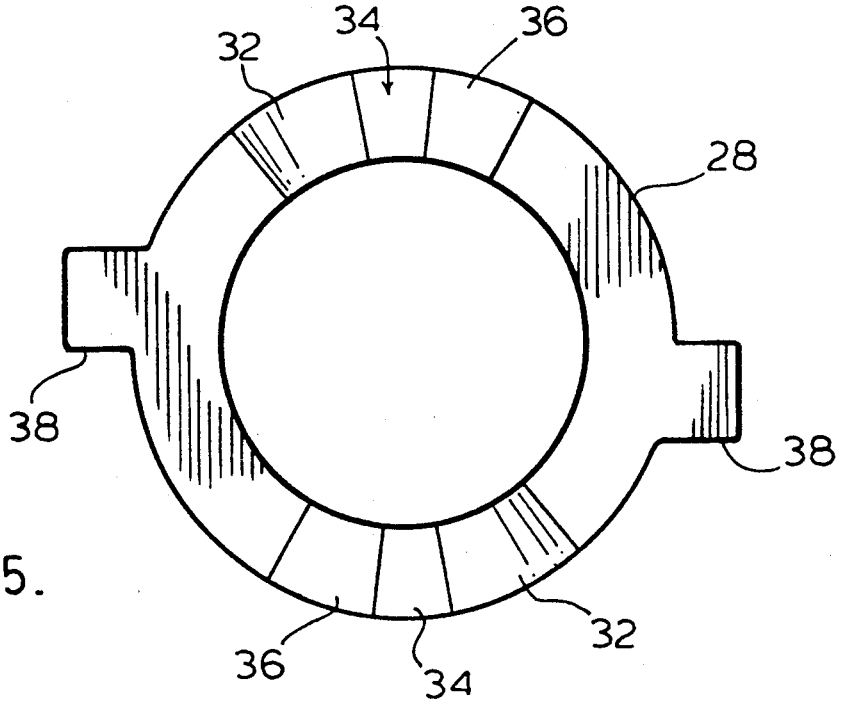
FIG. 5 is a top plan view of the washer of FIG. 1.
Figure 6:
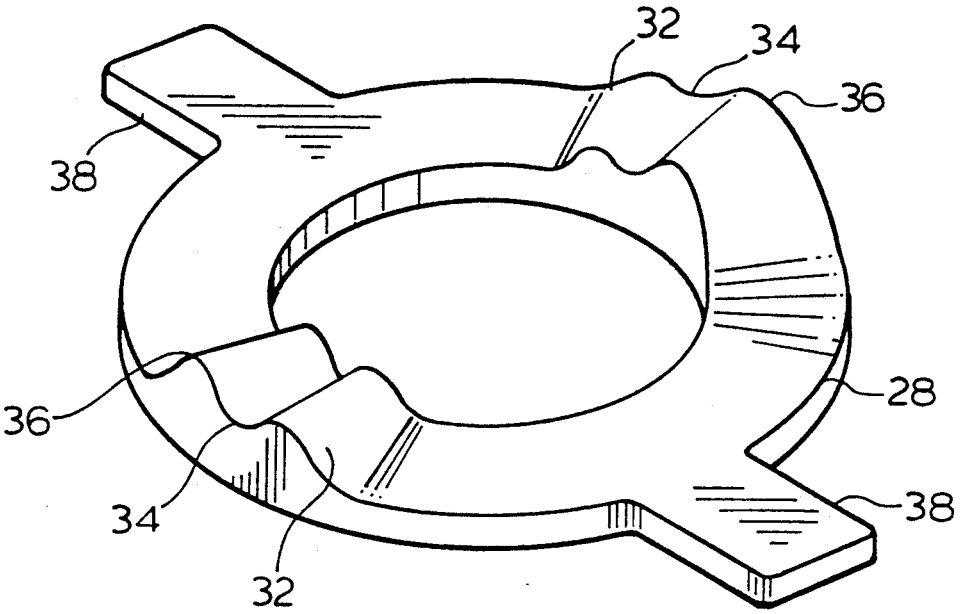
FIG. 6 is a perspective view of the washer of FIG. 1.

Referring to FIG. 5, washer 28 is generally a ring having at least a pair of diametrically opposed cam lobes 30. Each cam lobe has an inclined wedge surface 32, a cradling surface 34 and a stop 36 as illustrated in FIGS. 4 and 5. Extending from the ring, washer 28 has a pair of diametrically opposed abutment surfaces 38. Cradling surface 34 is contoured to receive and cradle pin 26. Stop 36 prevents washer 36 from rotating in one direction relative to pin 26 when pin 26 is cradled in cradling surface 34. The distance from cradling surface 34 to the ring portion of washer 28 is the difference in length which the shoring post 10 will retract. Accordingly, for greater retraction, this distance can be varied on different sized washers by varying the height of cradling surface 34. Additionally, the angle of the inclined wedge surface 32 will determine the rate of detraction as the washer rotates. The more abrupt the retraction, the steeper the incline.

The face of washer 28 opposite the face having lobes 30 is generally planar for abutting with an end of a support post 12.

To assemble, washer 28 is presented to telescoping sleeve 14. The lower end of sleeve 14 is presented into support post 12 in a sliding fit.

In use, the shoring post 10 is extended until it approximately equals the desired length between a support surface 40 and a supported surface 42. Pin 26 is inserted through the nearest pair of opposed holes 22. Washer 28 is rotated until cradling surface 34 is immediately below pin 26. Adjustment handle 16 is rotated extending the overall length of shoring post 10 until the shoring post fully supports the load of the supported surface. In this load transfer position, the load is transmitted from the telescoping sleeve 14, through the pin 26 to the cam lobe 30 to handle 16 and finally to the support post 12.

To quickly release the shoring post 10, a hammer contacts one of abutment surfaces 38. Washer 28 is urged in a direction relatively opposite the stop 36 causing the pin to travel relatively down the inclined surface 32, reducing the overall length of the shoring post 10 and reducing the pressure acting on the handle 16 allowing the handle to be easily turned and unscrewed reducing length of shoring post 10 which allows telescoping sleeve 14 to retract into support post 12.

In the preferred embodiment, the circumferential length of cam lobes 30 is less than one quarter of the circumferential distance of the ring of washer 28. In this manner less than one quarter rotation of the washer is necessary to reduce the overall length of the shoring post 10.

In other embodiments, handle 16 could easily be replaced with a nut threadably engaging the support post 12. Other methods of fine adjustment could be used with the present invention, including the use of a collar having a hinged handle threadable engaging a threaded support tube wherein the pin supporting the telescoping member extends through a vertical slot.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A shoring post comprising a support post slidingly engaging a telescoping sleeve member, a screw means for incrementally adjusting the length of said shoring post, said telescoping member having a plurality of pairs of diametrically opposed holes spaced therealong, a pin member for inserting through a pair of said diametrically opposed holes of said telescoping member to releasably extend said shoring post, wherein the improvement comprises a quick release washer for quickly reducing an overall length of said shoring post, said washer comprising a ring portion having a pair of diametrically opposed cam lobes, said lobes having an inclined surface and a cradling surface, said washer mounted between said pin and said support post, said washer is rotatable between a load transfer position wherein said pin is cradled on the cradling surface and a quick release position wherein as said washer is rotated relative to the pin, the pin travels along the inclined surface reducing the overall length of the shoring post.

2. A shoring post as claimed in claim 1 wherein said washer includes abutments means for receiving hammer blows for urging said washer to rotate relative to said pin.

3. A shoring post as claimed in claim 2 wherein said screw means is a nut member threadably mounted on one end of said support post and said washer abuts said nut member.

4. A quick release washer for a shoring post, said shoring post comprising a support post slidingly engaging a telescoping sleeve member, a screw means for incrementally extending said shoring post, said telescoping member having a plurality of pairs of diametrically opposed holes spaced therealong, a pin member for inserting through a pair of said diametrically opposed holes of said telescoping member to releasably extend said shoring post, said washer comprising a ring portion having a pair of diametrically opposed cam lobes, said lobes having an inclined surface and a cradling surface, said washer mounted between said pin and said support post, said washer is rotatable between a load transfer position wherein said pin rests on the cradling surface and a quick release position wherein as said washer is rotated relative to the pin, the pin travels along the inclined surface retracting the shoring post.

5. A washer as claimed in claim 4 wherein said washer includes abutments means for receiving hammer blows to cause said washer to rotate relative to said pin.

6. A washer as claimed in claim 5 wherein said cam lobes include a stop surface for restricting the direction of the relative rotation of the washer.

7. A washer as claimed in claim 6 wherein said washer moves from the cradle position to the quick release position upon less than one quarter rotation of said washer.

* * * * *